US006141820A

United States Patent [19]

Schmiedhoff et al.

[11] Patent Number: 6,141,820

[45] Date of Patent: Nov. 7, 2000

[54] FLOOR-CLOTH-TYPE COVERING

[75] Inventors: Michael Schmiedhoff; Carl-Uwe Tintelnot, both of Weinheim, Germany; Francesco Sartori, I-Monghidoro, Italy

[73] Assignee: Firma Carl Freudenberg, Weinheim, Germany

[21] Appl. No.: 09/091,442

[22] PCT Filed: Jun. 28, 1997

[86] PCT No.: PCT/EP97/03390

§ 371 Date: Dec. 2, 1998

§ 102(e) Date: Dec. 2, 1998

[87] PCT Pub. No.: WO98/18379

PCT Pub. Date: May 7, 1998

[30] Foreign Application Priority Data

Oct. 28, 1996 [DE] Germany ..... 196 44 679

[51] Int. Cl.[7] ..... A47L 13/20

[52] U.S. Cl. ..... 15/229.8; 15/229.4; 15/228

[58] Field of Search ..... 15/229.4, 229.8, 15/228, 229.1, 229.2, 229.3, 229.5, 229.6, 229.7, 229.9, 229.12, 229.13

[56] References Cited

U.S. PATENT DOCUMENTS 3,221,356 12/1965 Schirmer .
5,315,734 5/1994 Kresse et al. .
5,887,311 3/1999 Kresse et al. .

FOREIGN PATENT DOCUMENTS 0358844 4/1989 European Pat. Off. .
358 844 3/1990 European Pat. Off. .
29519746 9/1994 Germany .
43 21 242 C1 9/1994 Germany .
4321242 9/1994 Germany .
94 09 740 U 9/1994 Germany .
210694 10/1994 Germany .
295 19 746 U1 3/1996 Germany .
195 10824 C1 5/1996 Germany .
19510824 5/1996 Germany .

*Primary Examiner*—Deborah Jones
*Assistant Examiner*—Jennifer McNeil
*Attorney, Agent, or Firm*—Kenyon & Kenyon

[57] ABSTRACT

Wipe cover for floor cleaning, featuring a wipe-material layer having pile threads projecting from this layer in the direction of the surface to be cleaned, and means for securing to a retainer, at least one layer of non-woven fabric being provided, forming edges projecting beyond the wipe-material layer.

9 Claims, 2 Drawing Sheets

FLOOR-CLOTH-TYPE COVERING

BACKGROUND OF THE INVENTION

The invention relates to a wipe cover for floor cleaning, featuring a wipe-material layer having pile threads projecting from this layer in the direction of the surface to be cleaned, and means for securing to a retainer.

A wipe cover of this type is known from the German Patent 31 39 245 C2. A disadvantage here is its limited water- storing ability, so that it is possible to work with only a relatively small amount of water if the intention is to omit rewiping.

The object of the invention is to produce a wipe cover which, given small usage of material for the wipe-material layer, improves the water-storing ability in order to avoid rewiping, despite increased use of water.

SUMMARY OF THE INVENTION

According to the invention, at least one layer of non-woven fabric is provided, forming an edge projecting beyond the wipe-material layer. This non-woven fabric has increased water-storing ability in comparison to the pile threads made at least in part of synthetic fibers, between which only small amounts of water can be held. The edge, made of just this non-woven fabric and projecting beyond the wipe-material layer, first releases the water on the surface to be cleaned and loosens the dirt. The pile threads of the wipe-material layer following in the cleaning direction lift the dirt from the surface to be cleaned, and the edge of non-woven fabric, following in turn, absorbs the water again, now laden with dirt. Thus, increased water usage is possible in one work operation. Additionally, the edge acts as a buffer since, because of the relatively low stiffness of the non-woven fabric, the edge compresses when bumping against a piece of furniture or a baseboard, and thus lies between the retainer and the piece of furniture.

Particularly economical usage can be made of the wipe-material layer it is essentially the size of the area covered by the retainer and lies directly thereunder. In this case, only the non-woven layer projects beyond the retainer. However, since the transfer of force from the retainer to the wipe cover occurs significantly in the region of the retainer itself, and the cleaning performance of the unstressed edges must be estimated as very low in comparison to the surface under the retainer, the cleaning performance is not significantly lower overall.

To further improve the effectiveness of the wipe cover, at least two layers of non-woven fabric can be provided, thereby achieving a double-layering of the edge, as well. Due to the additional layer of non-woven fabric, a further increase in water storage is possible inside the wipe cover. This water supply is released by exercising pressure via the retainer, and can be absorbed again in response to diminishing pressure.

The layer facing the surface to be cleaned can have a cut-out in which the wipe-material layer is embedded. In this way, it is possible to improve the contact of the edge on the surface to be cleaned, since the cut-out layer of non-woven fabric is moved closer to the surface to be cleaned.

To increase durability, the joining of the wipe-material layer to the first layer is configured so as to be concealed between this layer and the second layer of non-woven fabric. The place of junction is thus not exposed to the mechanical stresses from the cleaning process itself Thus, it is possible to dispense with a wear-resistant thread in the case of a seam.

By joining the ends of the at least two layers of non-woven fabric, the seating of the edge on the floor is uniform and the deformation of the edge, for example when washing the wipe cover, is decreased.

In another specific embodiment, an edge increasing progressively in width can be provided, the respective upper layer overlapping the lower layer. Thus a seating of the individual layers on the floor at varying distances to the retainer is achieved, and water absorption and release are promoted.

In another aspect of this invention, the formation of fringe using incisions in the nonwoven edge projecting beyond the wipe-material layer promotes take-up of dry dust particles.

To counter the wear on the wipe cover due to its being stretched on the retainer, a support layer is disposed on the side of the non-woven layer facing the retainer. The support layer is advantageously made of a polyester fabric whose strength contributes significantly to the shape retention of the wipe cover, and preferably is made of a material that does not rot.

If the support layer extends over the one or plurality of non-woven fabric layers, a high shape retention of the wipe cover is achieved for when it is being wrung out or washed in a washing machine, this property being supported by stitching all of the layers at the outer edge. In addition, the mechanical stress caused by stretching the cover on the retainer is isolated from the relatively soft non-woven layers.

BRIEF DESCRIPTION OF THE DRAWINGS

An exemplary embodiment of the wipe cover according to the invention is illustrated in the drawings, the retaining apparatus having been omitted.

DETAILED DESCRIPTION OF THE INVENTION

Figure 1:
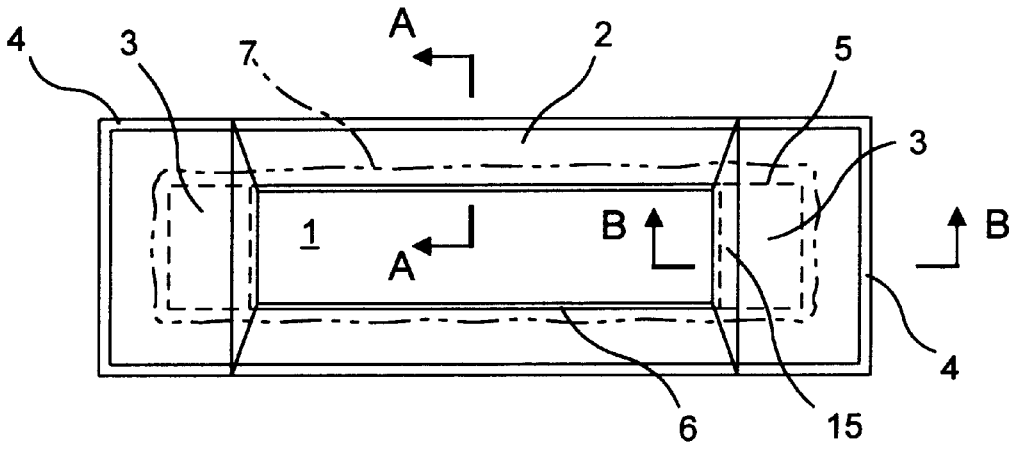
FIG. 1 is a top plan view of a wipe cover.

The wipe cover, shown in top view in FIG. 1, has a support layer 1, which has pockets 3 on its top side 2 for securing to a retainer, known per se and therefore not depicted. In the edge region, support layer 1 is joined to an equally sized layer of non-woven fabric disposed underneath it, with the assistance of a welting seam or piping 4. Seam 5, illustrated with a broken line, corresponds in its course approximately to the outer periphery of the retainer, which is supported first of all in pockets 3, and secondly by an additional cord 6.

Disposed on the bottom side of the wipe cover, not visible from above, is a wipe-material layer having an expanse represented by line 7, shown in FIG. 1 in phantom as a somewhat wavy line. Thus, the wipe-material layer is disposed under the retainer, essentially in the region of the retainer seating, thus permitting a direct transfer of force from the retainer onto the wipe-material layer.

Figure 2:
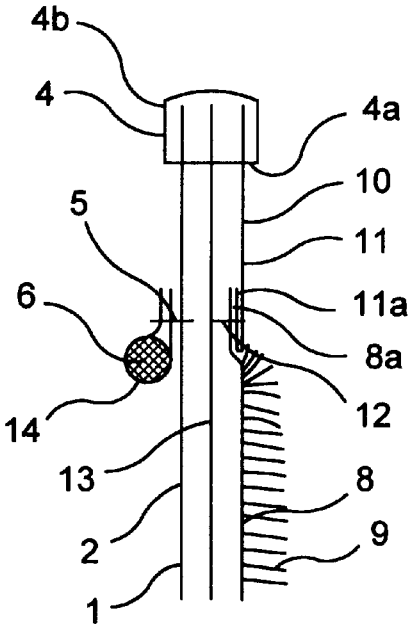
FIG. 2 is a section taken along line A from FIG. 1.

The construction of the wipe cover is depicted in greater detail in FIG. 2. Starting from wipe-material layer 8 having pile threads 9 directed toward the surface to be cleaned, the wipe cover has an edge 10, which surrounds the wipe-material layer 8 on all sides. Edge 10 is made of a first layer 11 of non-woven fabric, this first layer 11 exhibiting an approximately rectangular outer shape having in the middle an approximately rectangular recess the size of the retainer. Wipe-material layer 8 is inserted into this recess and is stitched with the assistance of overhanging hem 8*a* to layer 11 on the side of layer 11 facing away from the wipe side. In this context, hem 11*a* is created by folding over layer 11 inwardly. A seam 12 joins hems 8*a* and 11*a*.

To increase the water absorption capacity, a second layer 13 of non-woven fabric is disposed on the back side of wipe-material layer 8 and first layer 11, second layer 13 having outer dimensions corresponding to first layer 11.

To reduce the risk of and provide protection against mechanical attack due to inserting the retainer or by wringing out the wipe cover, support layer 1 is arranged as a covering over the entire surface as well.

First layer 11, second layer 13 and support layer 1 are joined either by a welting seam or piping 4. This welting seam or piping 4 has a seam 4*a* penetrating all of the layers. The edges of the layers are enclosed and protected by part 4*b*.

Cord 6 is surrounded by band 14, which is stitched to support layer 1 by a seam 5. Given a corresponding fixing of the individual components to one another, seam 5 and seam 12 can be configured as a single seam, if seam 12 need not be concealed.

Figure 3:
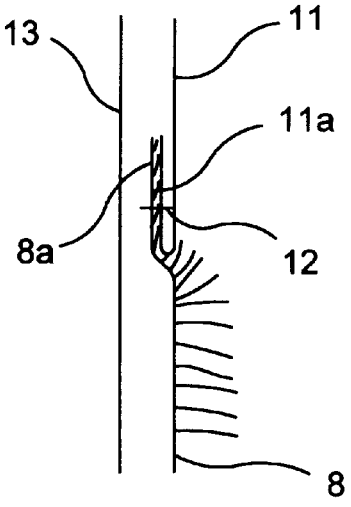
FIG. 3 is an enlargement of the transition region of the wipe-material layer into the edge.

FIG. 3 illustrates an enlargement of the region in which wipe-material layer 8 is secured to first layer 11. Hem 11*a*, which is formed by folding over non-woven fabric layer 11, as well as hem 8*a* of wipe-material layer 8, located between first layer 11 and second layer 13, are clearly visible in this figure. Seam 12 joins hems 8*a* with 11*a* and remains concealed, viewed from the wipe side. Thus, seam 12 is not exposed to the mechanical attacks presented by the surfaces to be cleaned. It is, of course, also possible to stitch seam 12 through with a suitably selected thread material.

Figure 4:
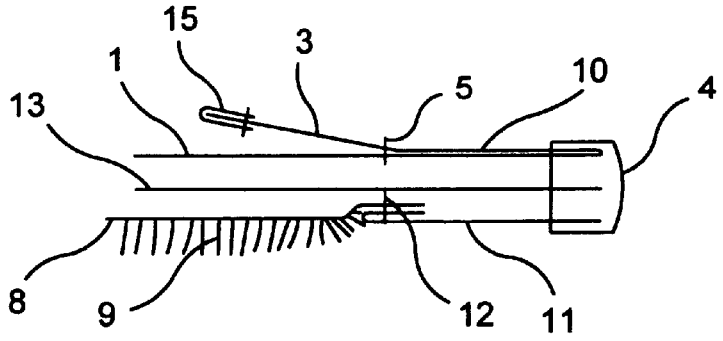
FIG. 4 is a section taken along line B from FIG. 1.

In FIG. 4, the wipe cover is illustrated in a longitudinal section in the region of pockets 3 for receiving the retainer. These pockets 3 are formed by folding over support layer 1 and are bounded by seam 5. This results in a double-layering of support layer 1 in edge region 10.

It is also possible, of course, to join pockets 3 separately to support layer 1 using seam 5. The pockets are edged at their open ends by band 15 and stand away slightly there from the reinforcement layer, to facilitate the insertion of the retainer. This band 15 can extend up to welting seam or piping 4 and be secured there; it can, however, also be limited in the longitudinal direction by seam 5.

Figure 5:
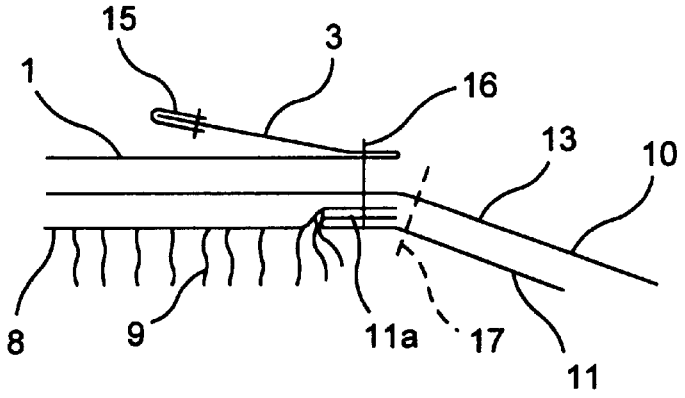
FIG. 5 is a further specific embodiment of the edge in the section corresponding to line B.
Figure 6:
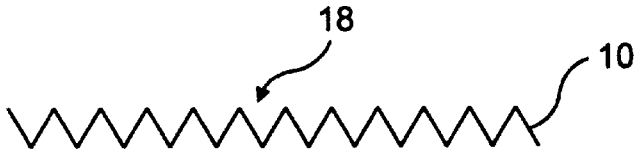
FIG. 6 is a further specific embodiment of the edge.

Edge 10 can have notches 18 to form fringe, as illustrated in FIG. 6, or it can be formed from layers 11 and 13 of varying edge widths, as illustrated in FIG. 5. In the latter case, a progressive contact of the fringe ends on the floor is achieved, but edge 10 also attains improved contact with this configuration if it is not notched.

Layers 11 and 13 are joined to wipe-material layer 8 and support layer 1 by a single seam 16, which also allows the formation of pockets 3 or the application of a cord stitched into a band. In so doing, it is not absolutely necessary that seam 16 penetrates through layer 11 to the bottom side of the wipe cover, rather it can also be sufficient to only execute seam 16 up to hem 11*a*. This can be achieved by temporarily folding edge 10 of layer 11 onto wipe-material layer 8. After completion of the stitching procedure, edge 10 of layer 11 is returned to the position illustrated. To fix edge 10 of layer 11 in position, additional seam 17 can be implemented in a region outside of the active cleaning surface of wipe-material layer 8, the seam joining layers 11 and 13 to one another. This can also be achieved through adhesion, for example, by fusing the non-woven fabric.

What is claimed is:

1. A wipe cover for floor cleaning, comprising:

a wipe-material layer having pile threads that project from this layer in the direction of a surface to be cleaned;

means for securing the wipe-material layer to a retainer, wherein the wipe material layer is sized to be essentially covered by the retainer so that when a retainer is provided, the retainer overlies most of the wipe-material layer enabling forces to be transmitted directly from the retainer to the wipe-material layer;

at least a first layer and a second layer of non-woven fabric, forming a border projecting beyond the wipe-material layer, wherein the first layer of non-woven fabric faces the surface to be cleaned and has a recess into which the wipe-material layer is embedded; and a secure mechanical connection of the wipe-material layer to the first layer, the connection being disposed so as to be concealed between the first layer and the second layer of non-woven fabric.

2. The wipe cover as defined by claim 1, wherein the at least two layers of non-woven fabric have edge at which they are joined, preferably by a piping or welting seam.

3. The wipe cover as defined by claim 2, wherein the layer of non-woven fabric disposed closest to the surface to be cleaned is narrower than the overlying layer of non-woven fabric.

4. The wipe cover as defined by claim 3, wherein the layers of non-woven fabrics have a peripheral edge, and wherein the edge of at least one of the layers of non-woven fabric projecting beyond the wipe-material layer has notches, thereby forming fringe.

5. The wipe cover as defined by claim 1, wherein the layer of non-woven fabric disposed closest to the surface to be cleaned is narrower than the overlying layer of non-woven fabric.

6. The wipe cover as defined by claim 1, wherein the layers of non-woven fabrics have a peripheral edge, and wherein the edge of at least one of the layers of non-woven fabric projecting beyond the wipe-material layer has notches, thereby forming fringe.

7. The wipe cover as defined by claim 1, wherein a support layer is disposed on the side of the layer of non-woven fabric facing the retainer.

8. The wipe cover as defined by claim 1, wherein a support layer is disposed on the side of the layer of non-woven fabric facing the retainer.

9. The wipe cover as defined by claim 8, wherein the support layer extends over one or a plurality of layers of non-woven fabric, and is joined to the non-woven fabric along an outer part of the edge.

* * * * *

UNITED STATES PATENT AND TRADEMARK OFFICE

CERTIFICATE OF CORRECTION

PATENT NO. : 6,141,820
DATED : November 7, 2000
INVENTOR(S) : Schmiedhoff et al.

It is certified that error appears in the above-identified patent and that said Letters Patent is hereby corrected as shown below:

Column 1,
Line 65, change "itself Thus" to -- itself. Thus --; and replace Abstract with the following substitute abstract:
-- A floor-cloth type covering for cleaning floors. The covering has a wiping material layer with piles threads projecting from the latter in the direction of the surface to be cleaned, and includes structure for attachment to a carrier. At least one layer of non-woven material is provided, forming edges projecting beyond the wiping layer. --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*